US006014158A

United States Patent [19]

Ziegelmuller et al.

[11] Patent Number: 6,014,158

[45] Date of Patent: Jan. 11, 2000

[54] TRANSFER ROLLER ELECTRICAL BIAS CONTROL

[75] Inventors: Francisco L. Ziegelmuller, Penfield; George R. Walgrove, Rochester; David E. Hockey, Brockport, all of N.Y.

[73] Assignee: Eastman Kodak Company, Rochester, N.Y.

[21] Appl. No.: 08/841,008

[22] Filed: Apr. 29, 1997

[51] Int. Cl.[7] ..... B41J 2/40

[52] U.S. Cl. ..... 347/142

[58] Field of Search ..... 347/142, 235, 347/250; 399/55, 66, 88, 121, 301, 313, 314

[56] References Cited

U.S. PATENT DOCUMENTS

| | | | |
|---|---|---|---|
| 3,572,923 | 3/1971 | Severynse et al. . | |
| 3,655,373 | 4/1972 | Fisher et al. . | |
| 3,848,994 | 11/1974 | Fraser . | |
| 4,382,673 | 5/1983 | Nakajima et al. . | |
| 5,031,000 | 7/1991 | Pozniakas et al. . | |
| 5,101,238 | 3/1992 | Creveling et al. . | |
| 5,196,885 | 3/1993 | Takeuchi et al. . | |
| 5,253,022 | 10/1993 | Takeuchi et al. . | |
| 5,337,127 | 8/1994 | Imaue . | |
| 5,404,213 | 4/1995 | Okano et al. . | |
| 5,410,393 | 4/1995 | Watanabe . | |
| 5,455,664 | 10/1995 | Ito et al. | 399/66 |
| 5,489,972 | 2/1996 | Shuster et al. . | |
| 5,491,544 | 2/1996 | Kenin et al. . | |
| 5,504,565 | 4/1996 | Tomiki et al. . | |
| 5,559,590 | 9/1996 | Arai et al. . | |
| 5,713,063 | 1/1998 | Oono | 399/66 |

*Primary Examiner*—John Barlow
*Assistant Examiner*—Raquel Yvette Gordon
*Attorney, Agent, or Firm*—Lawrence P. Kessler

[57] ABSTRACT

An electrostatographic reproduction apparatus having a transfer assembly, including an electrically biased transfer roller in nip relation with a dielectric support member, for effecting transfer of a pigmented marking particle image from an image area of a dielectric support member to a receiver member in transfer relation with the dielectric support member in the transfer nip, a mechanism for cleaning the transfer roller including a control for the electrical bias on the transfer roller. The electrical bias control has a power supply generating an electrical output, of a settable polarity, connected to the transfer roller for applying an electrical bias of a set polarity thereto. A timing signal generator produces signals respectively corresponding to the location of a receiver member relative to the transfer nip. A mechanism, responsive to the signal from the timing signal generator, indicating the passing of the trail edge of a receiver member through the transfer nip, reverses the setting of the polarity of the electrical output from the power supply so as to prevent transfer of residual marking particles from the dielectric support member to the transfer roller.

10 Claims, 3 Drawing Sheets

TRANSFER ROLLER ELECTRICAL BIAS CONTROL

BACKGROUND OF THE INVENTION

The present invention relates in general to reproduction apparatus utilizing an electrically biased roller for transferring a marking particle image from an image bearing dielectric support member to a receiver member, and more particularly to control for the electrical bias of the reproduction apparatus transfer roller in order to optimize cleaning thereof.

In typical commercial electrostatographic reproduction apparatus (copier/duplicators, printers, or the like), a latent image charge pattern is formed on a uniformly charged charge-retentive or photo-conductive member having dielectric characteristics (hereinafter referred to as the dielectric support member). Pigmented marking particles are attracted to the latent image charge pattern to develop such image on the dielectric support member. A receiver member, such as a sheet of paper, transparency or other medium, is then brought into contact with the dielectric support member, and an electric field applied to transfer the marking particle developed image to the receiver member from the dielectric support member. After transfer, the receiver member bearing the transferred image is transported away from the dielectric support member, and the image is fixed (fused) to the receiver member by heat and pressure to form a permanent reproduction thereon.

Application of the electric field to effect marking particle image transfer is generally accomplished by ion emission from a corona charger onto the receiver member while in contact with the dielectric support member. Alternatively, an electrically biased roller, urging the receiver member against the dielectric support member, has been used to cause the marking particles on the dielectric support member to move to the receiver members. That is, the transfer roller is electrically biased so as to charge the receiver member with the opposite polarity to that of the marking particles. Roller transfer apparatus offer certain advantages over corona transfer apparatus in that the roller transfer apparatus substantially eliminate defects in the transferred image due to paper cockle or marking particle flakes. This result stems from the fact that the pressure of the roller urging the receiver member against the dielectric support member is remarkably efficient in providing intimate uniform contact therebetween.

However, during operation of roller transfer apparatus, background marking particles, or marking particles outside the area of the receiver member may be picked up by the transfer roller resulting in contamination of the roller. Transfer roller contamination may eventually result in contamination of the backside of receiver members passing between the transfer roller and the dielectric support member. The backside of the receiver members are those sides facing the transfer roller surface. In order to minimize transfer roller contamination, a cleaning subsystem may be added to the roller transfer assembly. The cleaning subsystem which is preferentially used in current practice is that of a rotating fur brush and an associated vacuum. The fur brush typically rotates at high speeds, and the vacuum induced high air velocity is required to clean the brush and transport the airborne marking particles and other contaminants to a filter. Thus it can be appreciated that roller transfer apparatus are more complex than corona transfer apparatus in that they require cleaning due to their tendency to pick up marking particles from the dielectric support member and undesirably deposit such particles on the back side of the receiver member. Further, the roller transfer apparatus, including their respective cleaning assemblies, must be constructed so as not to interfere with ready clearance of any jammed receiver members.

Examples of selectively positionable roller transfer apparatus constructed to include integral cleaning mechanisms, are shown in U.S. Pat. Nos. 5,101,238 (issued Mar. 31, 1992, in the names of Creveling et al), and 5,491,544 (issued Feb. 13, 1996, in the names of Kenin et al). While roller transfer apparatus with associated cleaning mechanisms of this type are generally effective in providing for reliable image transfer to receiver members and efficient transfer roller cleaning, under certain circumstances the transfer roller cleaning is insufficient. This is particularly the case with charged area development (CAD) or discharged area development (DAD) where process control patches are developed in the interframe between marking particle images. Contamination is also picked up by the transfer roller from the dielectric support member splice. The cleaning mechanisms described in the aforementioned patents can be ineffective as presently configured to handle such process control patch contamination or dielectric support member splice contamination picked up by the transfer roller. Further, in discharge area development (DAD), the contamination problem may be accentuated (may be material dependent). This is due to the polarity of charge on residual marking particles, or marking particles in the interframe between images, urging the marking particles to the transfer roller to contaminate the roller.

SUMMARY OF THE INVENTION

In view of the foregoing discussion, this invention is directed to an electrostatographic reproduction apparatus having a transfer assembly, including an electrically biased transfer roller, for effecting transfer of a pigmented marking particle image from an image area of a dielectric support member to a receiver member in transfer relation with the dielectric support member, a mechanism for cleaning the transfer roller, the cleaning mechanism including a device for controlling electrical bias on the transfer roller. The electrical bias control device has a power supply for generating an electrical output with a set polarity. The electrical output is connected to the transfer roller for applying an electrical bias of a set polarity thereto. A detector respectively senses the lead and trail edges of a receiver member relative to transfer relation with the dielectric support member, and produces a corresponding signal representative thereof. A mechanism, responsive to the signal from the detector indicating the sensing of the trail edge of a receiver member, reverses the polarity of the electrical output from the power supply to prevent (repel) the transfer of residual marking particles from the dielectric support member to the transfer roller.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
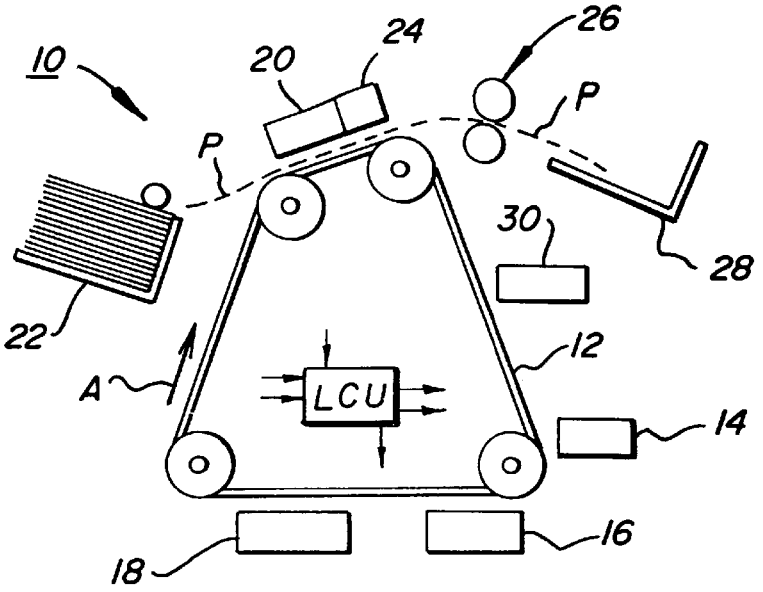
FIG. 1 is a schematic illustration of a reproduction apparatus employing the electrical biased transfer roller assembly and control for such roller according to this invention.

Referring now to the accompanying drawings, FIG. 1 schematically illustrates a typical electrostatographic reproduction apparatus 10 suitable for utilizing an exemplary roller transfer assembly (designated generally by the numeral 20), such as shown and described in aforementioned U.S. Pat. No. 5,491,544. The reproduction apparatus 10 and the roller transfer assembly 20 are described herein only to the extent necessary for a complete understanding of this invention. The electrostatographic reproduction apparatus 10 is under the control of a microprocessor-based logic and control unit L of any well known type. Based on appropriate input signals and programs supplied by software control algorithms associated with the microprocessor, the logic and control unit L provides signals for controlling the operation of the various functions of the reproduction apparatus for carrying out the reproduction process. The production of suitable programs for commercially available microprocessors is a conventional skill well understood in the art. The particular details of any such programs would, of course, depend upon the architecture of the designated microprocessor.

The reproduction apparatus 10 includes a dielectric support member 12, for example, in the form of an endless web mounted on support rollers and movable about a closed loop path in the direction of arrow A through a series of electrographic process stations. Of course, this invention is suitable for use with other dielectric support member configurations, such as drums for example. In the reproduction cycle for the reproduction apparatus 10, the moving dielectric support member 12 is uniformly charged as it moves past a charging station 14. Thereafter the uniformly charged dielectric support member passes through an exposure station 16 where the uniform charge is altered to form a latent image charge pattern corresponding to information desired to be reproduced. Depending upon the characteristics of the dielectric support member and the overall reproduction system, formation of the latent image charge pattern may be accomplished by exposing the dielectric support member to a reflected light image of an original document to be reproduced or "writing" on the dielectric support member with a series of lamps (e.g., LED's or lasers) or point electrodes activated by electronically generated signals based on the desired information to be reproduced. The latent image charge pattern on the dielectric support member 12 is then brought into association with a development station 18 which applies pigmented marking particles to adhere to the dielectric support member to develop the latent image. The portion of the dielectric support member carrying the developed image then passes through a transfer station 20 in register with a receiver member fed in proper timed relation from a supply hopper 22 along the path P. An electric field produced in the transfer station attracts the marking particles of the developed image from the dielectric support member to the receiver member.

The electric transfer field may also cause the receiver member to adhere to the dielectric support member. Accordingly, a detack device 24, immediately downstream in the direction of travel of the dielectric support member, is provided to facilitate removal of the receiver member from the dielectric support member. The detack mechanism may be, for example, and AC corona charger for reducing or neutralizing the attractive field holding the receiver member to the dielectric support member. After the developed image is transferred to the receiver member and the receiver member is separated from the dielectric support member, the receiver member is transported through a fusing device 26 where the image is fixed to the receiver member by heat and/or pressure for example, and delivered to an output hopper 28 for operator retrieval. Simultaneously, the dielectric support member 12 is cleaned of any residual marking particles at cleaning station 30 and returned to the charging station 14 for reuse.

Figure 2:
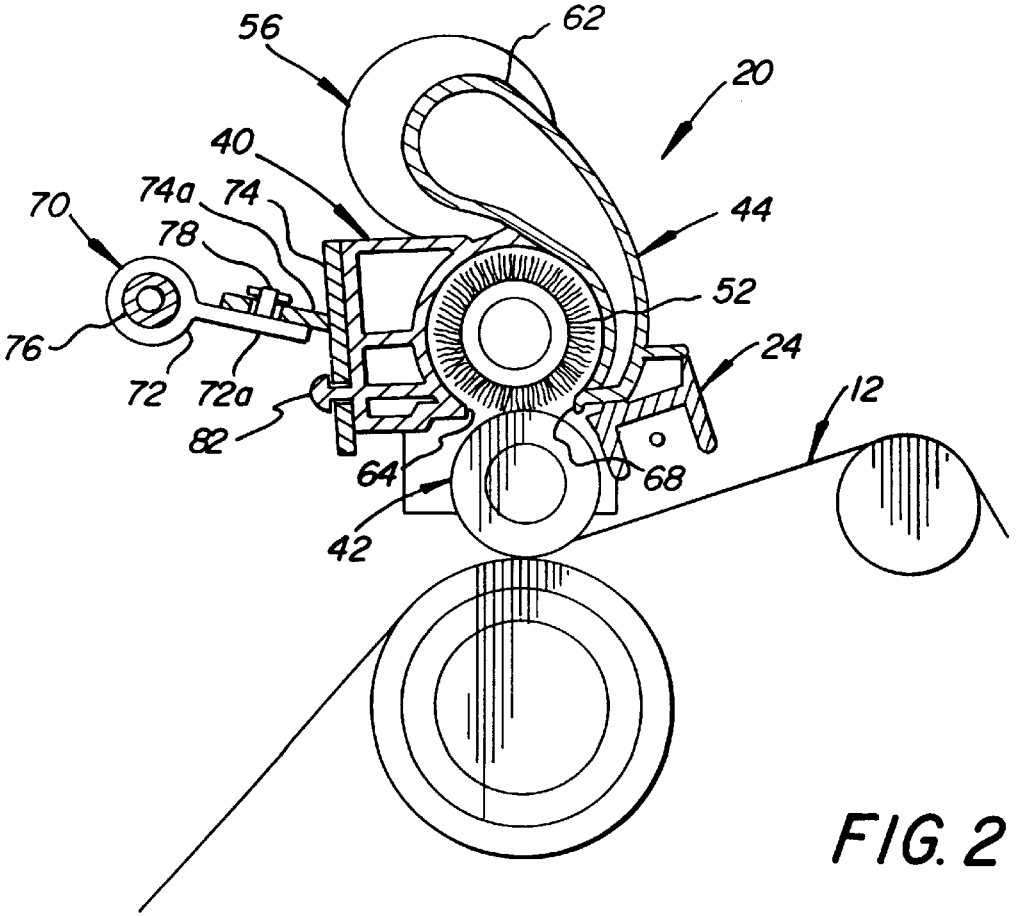
FIG. 2 is a side elevational view, partly in cross-section and on an enlarged scale, of the electrical biased transfer roller assembly of FIG. 1.
Figure 3:
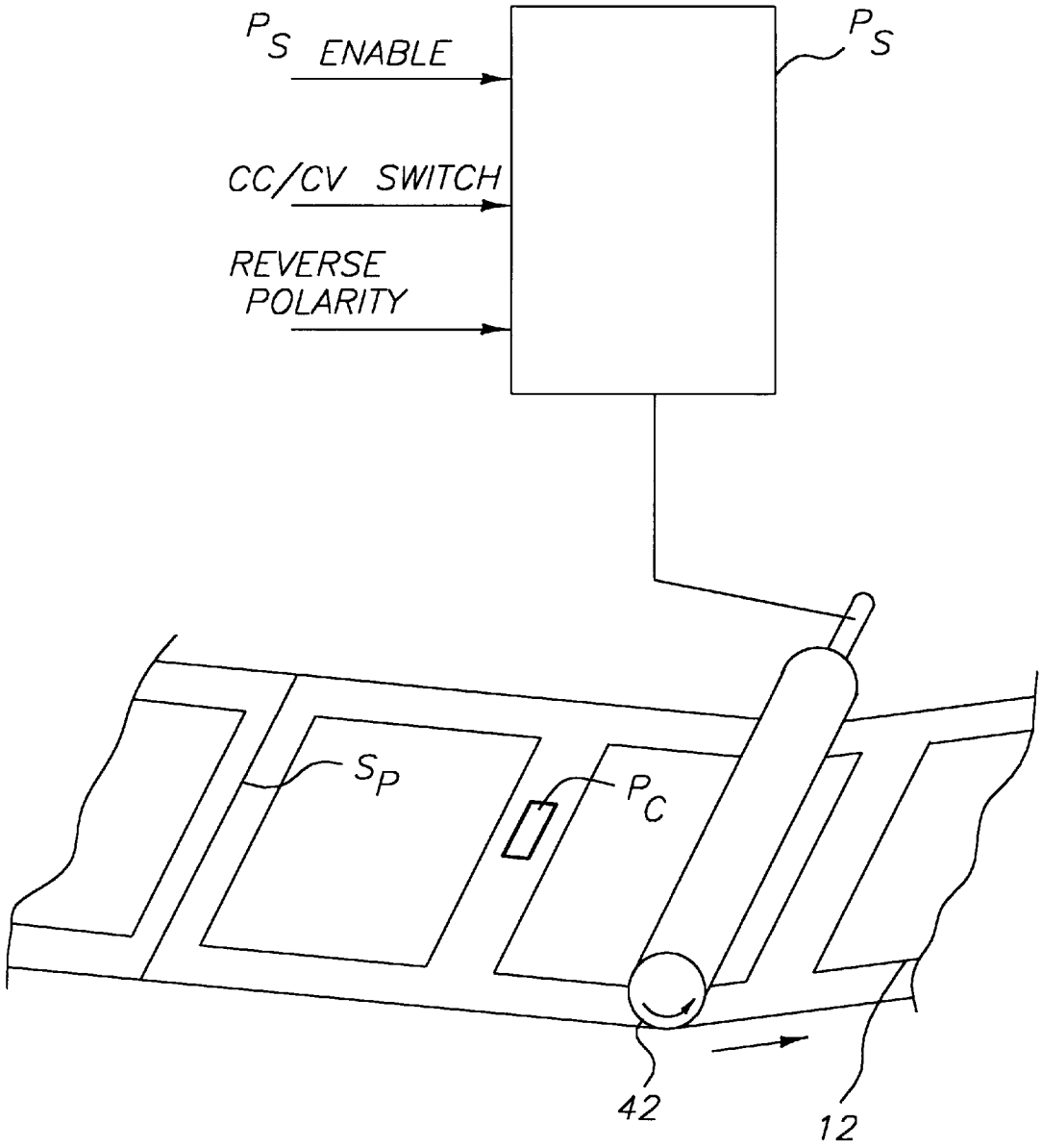
FIG. 3 is a view on an enlarged scale, in perspective of the electrical biased transfer roller assembly and photoconductive web of the reproduction apparatus, as shown in FIG. 1.

Turning now to the exemplary transfer station 20, as noted above such station is for example a roller transfer assembly which is described hereinbelow with particular reference to FIG. 2 in sufficient detail for a complete understanding of this invention. Of course, other roller transfer assemblies are suitable for use with this invention. The roller transfer assembly includes a unitary housing 40 containing a transfer roller 42, a roller cleaning mechanism 44, and a detack device 24 in a compact configuration. An electrical bias is applied to the core of the roller 42 from a power supply $P_S$ (see FIG. 3) described in detail hereinbelow. As such, when the transfer roller is in operative association with the dielectric support member 12 (as shown in FIG. 2), an electrical transfer field is established which will efficiently transfer a marking particle developed image from the dielectric support member to a receiver member passing therebetween.

The detack device 24 of the roller transfer assembly is preferably an AC corona charger interconnected with the unitary housing 40. The detack device 24 is located such that when the roller transfer assembly 20 is in operative association with the dielectric support member 12, the detack charger is located downstream (in the direction of dielectric support member travel) from the transfer roller 42 to effectively provide a field which relieves the electrostatic attraction forces between the receiver member and the dielectric support member. In this manner, the receiver member is readily detacked from the dielectric support member for transport along it intended path P to the fusing device 26 (FIG. 1) without interference or jamming. With the compact arrangement for the roller transfer assembly as described, a mounting is provided, designated generally by the numeral 70. The mounting 70 enables the roller transfer assembly to contact the dielectric support member 12 in a manner so as to impart no steering forces to the moving dielectric support member.

When the transfer roller 42 contacts the dielectric support member 12 with no receiver member therebetween, the transfer roller tends to pick up residual marking particles from the dielectric support member. On passes of subsequent receiver members to accomplish developed image transfer, the marking particles on the transfer roller 42 can be deposited on the back side of the receiver members to form undesirable marks thereon. Accordingly, the transfer roller 42 must be efficiently continuously cleaned. The cleaning mechanism 44 of the roller transfer assembly 20 includes an elongated, cylindrical, fiber brush 52. The brush 52 is supported in the unitary housing 40 such that the longitudinal axis of the brush is parallel to the longitudinal axis of the transfer roller 42. The respective longitudinal axes are spaced apart a distance such that a portion of the peripheral surface of the brush 52 contacts the transfer roller 42. A motor 56, attached to the unitary housing 40, is coupled to the brush 52 to rotate the brush at a high rate of speed and preferably in a direction such that, in the area of contact between the brush and the transfer roller, the two are moving in opposite directions to effectively sweep marking particles (and any accumulated paper dust) from the transfer roller into the fibers of the brush.

In order to keep the fibers of the brush 52 from becoming overloaded with marking particles cleaned from the transfer roller 42, the cleaning mechanism 44 also includes a vacuum air flow system 62, in flow communication with a vacuum blower (not shown). The air flow system forms an air flow directing chamber about the brush 52. The air flow chamber provides an air flow passage wrapping about a portion of the brush 52 with an opening 64 to the brush located adjacent to the peripheral surface of the brush downstream (in the direction of rotation of the brush) from the area of contact between the brush and the transfer roller and extending in the direction of the longitudinal axis of the brush. A lip 68 extends into the fibers of the brush. As the brush 52 is rotated by the motor 56, the lip 68 acts as a flicker bar to bend the brush fibers and snap the fibers to facilitate release of particulate material therefrom. Such freed particulate material is entrapped in the air flow stream and transported away from the cleaning mechanism to a remote collection location (not shown).

The fiber brush 52 of the transfer assembly cleaning mechanism 44 most effectively utilizes, for example, an acrylic fur brush having a 0.010" to 0.070" engagement (interference) with the transfer roller 42. The brush 52 rotates with a surface velocity in opposite direction to the transfer roller, and a speed in the range of about 1000–3000 RPM. The brush nap density is 12–15 oz/yd$^2$. Vacuum provided to the cleaner to remove contamination from the brush is maintained at an air flow above 15 cfm to prevent precipitation of marking particles from the contaminated air stream inside the brush housing.

Moreover, as discussed above, an electrostatographic reproduction apparatus 10 using a contacting, electrical biased, semi-conductive roller 42 for transferring marking particle developed images from the dielectric support member 12 to a receiver member, and using a marking particle developed patch in an interframe area for process control can have problems with marking of the backside of a receiver member following the process control patch. The marking particles of the process control patch transfer to the transfer roller 42, and if all the marking particles are not cleaned off in one revolution, the residual marking particles can mark the back of a subsequent receiver member. To resolve this problem according to this invention, it has been discovered that using a reverse electrical bias (same charge polarity as the marking particles) on the transfer roller when no receiver member is present in transfer relation between the dielectric support member and the transfer roller markedly reduces the amount of marking particles transferred to the roller and therefore substantially eliminates backside marking.

In the discharged area development (DAD) mode of operation for the reproduction apparatus 10, the dielectric support member 12 is charged negatively, for example, and the image developing marking particles are of negative polarity. In the discharged areas of the dielectric support member 12, such as over the interframes where the dielectric support member splice $S_P$ and process control patches $P_C$ are located (see FIG. 3), the dielectric support member voltage can be anywhere from −60 V to −500 V. The marking particles, being negative, will be weakly held by the dielectric support member 12, and will tend to move in the direction of a medium which is positive, such as the receiver member or the transfer roller surface.

With the DAD mode of operation, proper transfer roller electrical bias is selected to prevent or minimize pick-up of contamination from the dielectric support member splice $S_P$ and process control patches $P_C$. To minimize marking particle pick-up from discharged areas of dielectric support member 12, the transfer roller electrical bias is set to be in a range of about −250 V to −1000 V. The use of reverse electrical bias on the transfer roller serves to generate an electric field that will prevent transfer (i.e., repel, or drive, negative marking particles so that they remain on the dielectric support member 12), and thus reduce transfer roller contamination.

In the charged area development (CAD) mode of operation for the reproduction apparatus 10, the dielectric support member 12 is charged negatively and the marking particles are of positive polarity. The discharged areas of the dielectric support member 12 will be at a potential of −60 V to −150 V (after up to two typically applied erase steps, i.e. interframe/format erase, and post development erase). The marking particles, being positive, have higher attraction to the dielectric support member 12 than in DAD mode, and are less attracted to the transfer roller surface. The transfer roller electrical bias is thus switched to 0 V over the interframes. The transfer roller is accordingly perceived as positive to the marking particles which will then preferentially stay with the dielectric support member 12. The result is less marking particle pick up by the transfer roller from the dielectric support member 12, and consequently less contamination on the backside of sheets in the CAD mode.

Therefore according to this invention, in the DAD mode of operation of an electrostatographic reproduction apparatus, a high speed rotating fur brush, subject to vacuum, with the transfer roller electrical bias polarity being selectively reversed to arrive at a zero or negative electric field that drives negative marking particles to the dielectric support member, reduces pick up of contamination by the transfer roller. For the CAD mode of operation, the approach of switching the transfer roller electrical bias to 0 V substantially prevents backside contamination. It is also important that the transfer roller electrical bias has reached the desired electrical bias level when it move relatively past the process control patches or dielectric support member splice.

The reversing of the electrical bias on the transfer roller 42 has been shown to be most effective to enable superior cleaning performance to be achieved when utilized with the above described fur brush/vacuum arrangement. By the same token, such fur brush/vacuum arrangement must include the reversing electrical bias for the transfer roller to handle process control patch contamination and splice contamination. While increased brush speed, brush to transfer roller engagement and brush nap density have been shown to considerably improve the cleaning performance, the brush will wear at a higher rate. Therefore, the combination of the fur brush/vacuum cleaner with a reversing electrical bias approach, to handle the dielectric support member splice contamination and to also allow for one skip frame if the transfer roller has to handle process control patches, is most desirable. It has been found that the most efficient fur brush cleaning can be achieved using a brush with a nominal diameter of 1.2", having a speed in the range of about 2500–3000 RPM, and with a brush-to-transfer roller engagement of 0.070". Brush wear has been found to be highly correlated to paper residues picked up by the transfer roller.

In high speed electrostatographic reproduction apparatus, the time available to switch from the running electrical bias on the transfer roller to the reverse electrical bias is very short. To accomplish the switching in the time available, the power supply $P_S$ must be running in the constant voltage mode. However, for most efficient marking particle transfer, it is more common during image transfer for the power supply to be running in the constant current mode. Therefore, according to this invention, the power supply $P_S$ is provided with the ability to switch between the constant current and constant voltage mode of operation, to switch polarities, and to "lock in" the voltage it was running at in constant current mode in order to switch back to such voltage after running in the constant voltage mode.

Figure 4:
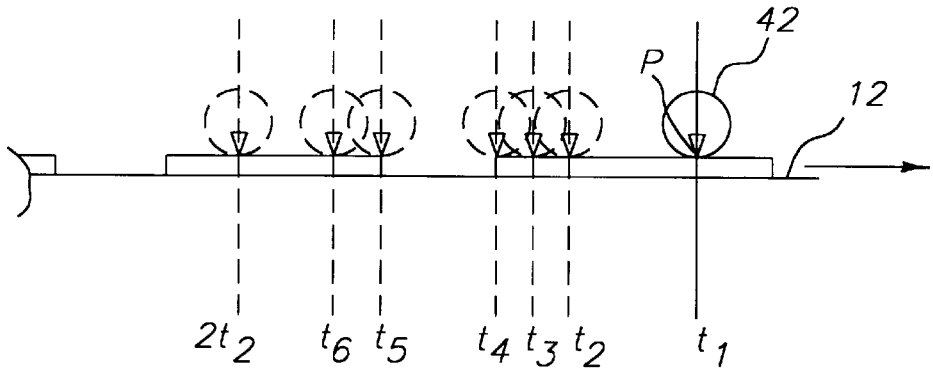
FIG. 4 is a flow diagram showing the operating sequence for the electrical biased transfer roller assembly and control for such roller according to this invention.
Figure 5:
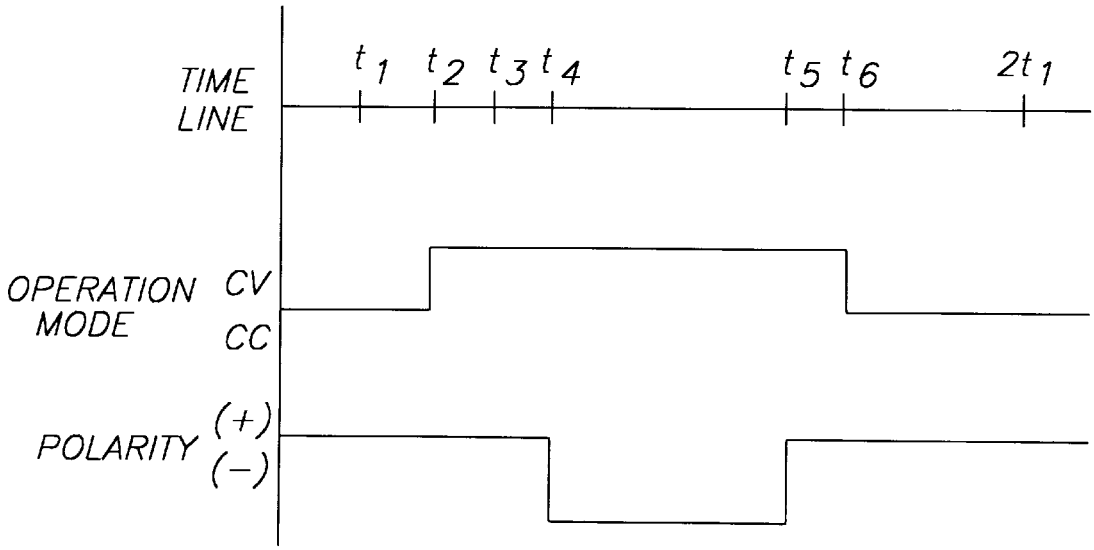
FIG. 5 is a diagram showing the time line for the operating sequence for the transfer roller.

The time line for determining the operational sequential location of the transfer roller 42 relative to a receiver member, and the electrical bias control switching sequence based on such time line are respectively shown with reference to FIGS. 4 and 5. A timing signal generator, such as detector D of any well known type (e.g., electromechanical, photoelectric, etc.), is provided to sense the lead and trail edges of the receiver sheet relative to the transfer nip and generate an appropriate signal for enabling control of the power supply $P_S$. The respective locations of the detector D and the transfer roller 42, relative to receiver members, is shown in solid lines at a time $t_1$, and in phantom lines for the remaining times $t_2$–$t_6$. Of course alternative timing techniques are suitable for use with this invention. For example, the times $t_1$–$t_6$ for this invention may be established from counted pulse signals from an encoder, associated with the dielectric support member 12 as it traverses its closed loop path, for providing input signals to the logic and control unit L for the reproduction apparatus.

At some time $t_1$, during transfer of a marking particle image to a receiver member, the electrical bias control maintains the power supply $P_S$ in the constant current (cc) mode at a positive (+) polarity. With the receiver member in the transfer nip, the power supply $P_S$ "locks in" and stores the running voltage. This running voltage is selected to provide the proper value to deliver the target current to the transfer roller 42 with the receiver sheet in the transfer nip. At the time $t_2$, as the trail edge of the receiver member approaches the transfer nip, the power supply $P_S$ changes to constant voltage (cv) mode. At the time $t_4$, shortly after the time $t_3$ where the trail edge of the receiver member is sensed by the detector D, an appropriate signal is generated and sent to the power supply $P_S$ which then switches to the reverse electrical bias level (−) where it remains for the interframe duration. If time restraints require earlier switching of the electrical bias level polarity, the time $t_4$ may be selected to occur prior to the sensing of the trail edge of a receiver member. However, the time $t_4$ must occur subsequent to passage of the image area beyond the transfer nip with the transfer roller.

As noted above, the rapid switching of polarity is possible because the power supply is functioning in the constant voltage mode. At the time $t_5$ at the end of the interframe, the detector D senses the lead edge of the next receiver member and generates an appropriate signal for the power supply $P_S$. The power supply then switches back to the voltage it stored during the previous image frame. After a short period of time passes to allow for the capacitive current to settle out, at the time $t_6$, the power supply $P_S$ returns to constant current mode, and the operative cycle is repeated starting at the time $2t_2$.

The invention has been described in detail with particular reference to preferred embodiment thereof, but it will be understood that variations and modifications can be effected within the spirit and scope of the invention as set forth in the claims.

What is claimed is:

1. An electrostatographic reproduction apparatus having a transfer assembly, including an electrically biased transfer roller in nip relation with a dielectric support member, for effecting transfer of a pigmented marking particle image from an image area of said dielectric support member to a receiver member, having a lead edge and a trail edge, transported along a path in transfer relation with said dielectric support member in said transfer nip, a mechanism for cleaning said transfer roller including a control for the electrical bias on said transfer roller, said electrical bias control comprising:

a power supply selectively generating an electrical output at constant current or constant voltage of a settable polarity, said power supply being connected to said transfer roller for applying an electrical bias of a set polarity to said transfer roller;

a timing signal generator producing signals respectively corresponding to a receiver member in said path relative to said transfer nip, wherein said constant current electrical output occurs during transfer, and said constant voltage electrical output occurs between a signal indicating a trail edge of a receiver member and a signal indicating a lead edge of a next subsequent receiver member entering said transfer nip, and said power supply locks in, for later recall, the voltage for said constant current electrical output; and means, responsive to a signal from said timing signal generator indicating said trail edge of a receiver member through said transfer nip, for reversing the set polarity of said electrical output from said power supply so as to prevent transfer of residual marking particles from said dielectric support member to said transfer roller.

2. The electrical bias control of claim 1 wherein, based upon said locked in voltage level, said power supply returns to said constant current electrical output when the lead edge of the next subsequent receiver member enters said transfer nip.

3. The electrical bias control of claim 2 wherein, when said power supply returns to said constant current electrical output after the lead edge of the next subsequent receiver member enters said transfer nip, the set polarity of said electrical output from said power supply is again reversed.

4. The electrical bias control of claim 1 wherein said timing signal generator includes a detector for respectively sensing the lead edge and trail edge of a receiver member relative to said transfer nip, and producing a corresponding signal representative of said lead or trail edge relative to said transfer nip.

5. An electrostatographic reproduction apparatus having a transfer assembly, including an electrically biased transfer roller for effecting transfer of a pigmented marking particle image from an image area of a dielectric support member to a receiver member having a lead edge and a trail edge, transported along a path in transfer relation with said dielectric support member, a mechanism for cleaning said transfer roller, said cleaning mechanism comprising:

a rotatable brush in operative association with said transfer roller;

a vacuum source operatively associated with said brush to remove accumulated residual marking particles therefrom;

a power supply, connected to said transfer roller, selectively generating an electrical output of a settable polarity at constant current or constant voltage, for applying an electrical bias at constant current or constant voltage of a set polarity to said transfer roller;

a timing signal generator producing signals respectively corresponding to a receiver member in said path relative to said transfer nip, wherein said constant current electrical output occurs during transfer, and said constant voltage electrical output occurs between a signal indicating a trail edge of a receiver member and a signal indicating a lead edge of a subsequent receiver member entering said transfer nip, and said power supply locks in, for later recall, the voltage for said constant current electrical output, and based upon said locked in voltage level, said power supply returns to said constant current electrical output when the lead edge of the next subsequent receiver member enters said transfer nip; and means, responsive to a signal from said timing signal generator indicating said trail edge of a receiver member through said transfer nip, for reversing the set polarity of said electrical output from said power supply so as to prevent transfer of residual marking particles from said dielectric support member to said transfer roller.

6. The electrical bias control means of claim 5 wherein, when said power supply returns to said constant current electrical output after the lead edge of the next subsequent receiver member enters said transfer nip, the set polarity of said electrical output from said power supply is again reversed.

7. The electrical bias control of claim 5 wherein said timing signal generator includes a detector for respectively sensing the lead edge and trail edge of a receiver member relative to said transfer nip, and producing a corresponding signal representative of said lead or trail edge relative to said transfer nip.

8. A method for controlling the electrical bias on said transfer roller in an electrostatographic reproduction apparatus having a transfer assembly, including an electrically biased transfer roller in nip relation with a dielectric support member, for effecting transfer of a pigmented marking particle image from an image area of said dielectric support member to a receiver member having a lead edge and a trail edge, transported along a path in transfer relation with said dielectric support member in said transfer nip, a mechanism for cleaning said transfer roller, said method comprising the steps of:

selectively generating an electrical output at constant current or constant voltage with a set polarity, and connecting such electrical output to said transfer roller for applying an electrical bias of a set polarity to said transfer roller;

sensing the respective lead and trail edges of a receiver member in said path relative to the transfer nip, and producing a signal representative thereof, wherein constant current electrical output occurs during transfer, and constant voltage electrical output occurs between a signal indicating a trail edge of a receiver member and a signal indicating a lead edge of a subsequent receiver member entering transfer relation with said dielectric support member, and the electrical output locks in, for later recall, the voltage for constant current electrical output; and responsive to said signal, reversing the set polarity of electrical output from said power supply to prevent transfer of residual marking particles from said dielectric support member to said transfer roller.

9. The method of electrical bias control of claim 8 wherein, based upon the locked in voltage level, the electrical output returns to said constant current electrical output when the lead edge of the next subsequent receiver member enters transfer relation with said dielectric support member.

10. The method of electrical bias control of claim 9 wherein, when said electrical output returns to said constant current electrical output after the lead edge of the next subsequent receiver member enters transfer relation with said dielectric support member, the set polarity of said electrical output is again reversed.

* * * * *